United States Patent [19]

Koomen

[11] 3,948,176

[45] Apr. 6, 1976

[54] MECHANICAL INITIATOR FOR DETONATION OF EXPLOSIVES

[75] Inventor: Nelis N. Koomen, Phoenix, Ariz.

[73] Assignee: Talley-Frac Corporation, Mesa, Ariz.

[22] Filed: Oct. 15, 1974

[21] Appl. No.: 514,793

[52] U.S. Cl. ..... 102/20; 102/70 R; 102/77; 166/299

[51] Int. Cl.[2] ..... F42B 3/10; F42C 5/00

[58] Field of Search ..... 102/16, 20, 21.6, 70 R, 102/73 R, 76 R, 77; 166/63, 299; 175/4.53, 4.56

[56] References Cited

UNITED STATES PATENTS

| | | | |
|---|---|---|---|
| 1,693,661 | 12/1928 | Ogden | 102/76 R |
| 3,191,678 | 6/1965 | Hinson | 166/299 |
| 3,754,496 | 8/1971 | Noel | 102/16 |

*Primary Examiner*—Verlin R. Pendegrass
*Attorney, Agent, or Firm*—Pennie & Edmonds

[57] ABSTRACT

A highly safe, wholly mechanically operable initiator is disclosed which is particularly suitable for initiating a liquid explosive in well fracturing and numerous other underground mining operations.

8 Claims, 5 Drawing Figures

MECHANICAL INITIATOR FOR DETONATION OF EXPLOSIVES

BACKGROUND OF THE INVENTION

In underground mining and drilling operations, it is often desired to increase the permeability and hence the productivity of a formation which has been penetrated by a well. Reasons for an unacceptably low rate of flow from a well may include such natural factors as the low permeability of the material which comprises the formation or the absence of fissures or other natural channels which have the effect of increasing the effective area exposed for production. Even after a well has successfully penetrated a formation and oil or any other product is being produced at an acceptable rate, continuous operation of the well over a period of time may result in the accumulation of asphaltic and waxy compounds or other materials which tend to clog the well and reduce its productivity.

An effective way in many cases to remedy one or more of these problems is by detonating a liquid explosive within the well bore or the formation. A number of techniques for explosive fracturing are described, for example, U.S. Pat. No. 3,191,678 to Hinson. Several techniques have been employed to detonate explosives in well bores, including timed detonators, detonators controllable through a wire line from the surface, and contact-actuated detonators. Contact-actuated detonators may be set-off electrically by an internal power supply through contact with a packer or similar device set in the well bore at the desired level (Hinson), or may be detonated by a "go-devil" dropped from the surface (e.g. U.S. Pat. No. 2,254,979), or may be inertially actuated when brought suddenly to a stop against a device set in the well bore (e.g. U.S. Pat. No. 3,410,214).

Inertially actuated detonators can be very hazardous for certain applications. Generally, a fluid column in the well limits their rate of travel down the casing and hence requires that they be set to go off when subject to a relatively small inertial force. Yet because of abrupt pressure changes often encounted in pumping fluids into a formation, the detonators may be subject to inertial forces adequate to be set off before ever reaching the pre-set depth stop.

Previously known contact-actuated detonators have also posed safety problems, such as the possibility of being detonated by sudden jarring due to pressure changes in the well while they are being loaded down to the desired depth. Some have also required alignment within narrow tolerances between special contact probes and the detonator contact, so that any misalignment readily leads to detonation failure, in itself a dangerous situation.

SUMMARY OF THE INVENTION

In accordance with the present invention, an improved and highly reliable detonation device is provided which is particularly useful in fracturing a geological formation traversed by a well bore.

The detonator may be used in connection with numerous underground mining techniques in addition to well fracturing and is useful for virtually any application where loading and remote actuation of the detonator is to be done by pressure through a bore or shaft.

The device is actuated only by axial pressure and does not respond to accelerations or decelerations as it passes down a well casing. In use in a well bore, a conventional cement retainer is first placed down the well casing adjacent to the formation to be fractured. This cement retainer acts as a stop and a positive control during the deposition of explosives and also triggers the detonator upon contact pressure over a predetermined threshold value.

The initiator or detonator of the present invention comprises an outer housing which forms an axially extending chamber within it. Axially mounted within the outer housing is an inner housing which contains an explosive in an inner chamber and carries an actuating member extending through the outer housing. In a preferred embodiment, relative movement between the inner and outer housing is restrained by shear pins which will not shear unless subjected to a force of predetermined magnitude. A percussion cap firing device is coupled to the explosive within inner chamber and is adapted to be actuated by axial movement of a hammer, or firing head, which is contained within the housing. The hammer is spring biased toward the firing device but is stopped from striking the firing device by a lock. Relative movement of the inner and outer housing compresses a spring disposed to drive the hammer toward the firing device and releases the lock, permitting the hammer to be driven by the spring against the firing device to detonate the explosive. Relative movement between the inner and outer housings can only be caused by a force great enough to shear the shear pins. This force is provided by the pressure of the fluid used to pump the detonator to the packer set in the bore at the desired point of detonation. This force acts on the top of the detonator, the outer housing of which is fitted with a resilient, fixed sleeve of the type conventionally used with plugs or the like to be pumped through well bores and which seals off the area between the detonator and the bore walls. The actuating member is smaller in diameter, or cross-sectional area, than the bore diameter so that it is not responsive to fluid pressures during movement within the bore but is actuable only through direct physical contact with the pre-set packer, and provided that adequate force is employed in forcing the detonator against the packer to exceed the pre-determined actuating force threshold of the detonator.

BRIEF DESCRIPTION OF THE DRAWINGS

The invention will be further illustrated in conjunction with the annexed drawings, in which.

DETAILED DESCRIPTION OF A PREFERRED EMBODIMENT

Figure 1:
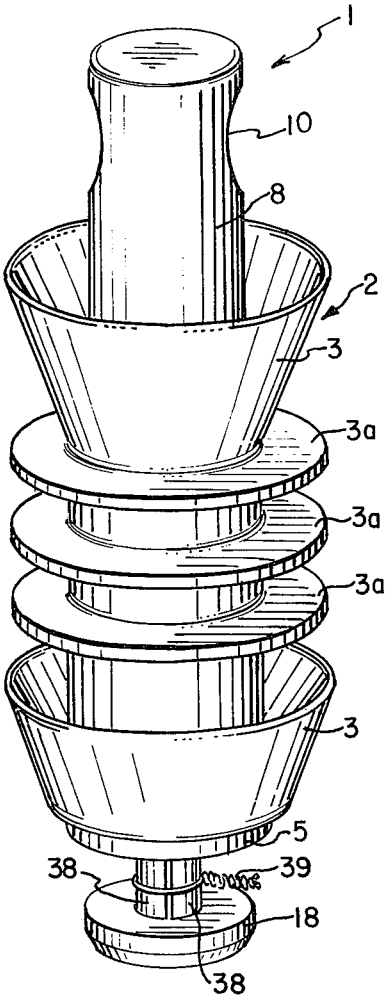
FIG. 1 is a perspective view of a mechanical initiator constructed in accordance with the present invention.

Referring to FIGS. 1–4, the mechanical initiator 1 of the present invention is enclosed in a flexible finned outer sleeve 2 which acts as a seal. It is made of rubber or any other flexible material as is well known in the prior art, so that annular fins 3, 3*a* allow the initiator to seat securely forming a pressure seal without regard to minor variations in the inner surface of the casing. Sleeve 2 is secured to an outer housing member 4 partially closed at its lower end by a closure 5. A seal is maintained between closure 5 and outer housing member 4 by an O-ring 6. Tightening of cap 5 into inner wall 4 may conveniently be facilitated through the provision of a pair of spanner wrench bores 7. An upper body member 8 is threaded into outer housing member 4 and together with closure 5 they form the outer housing. Proper sealing between upper body member 8 and member 4 is maintained by a flexible annular extension 9 of sleeve 2 which extends between them. Upper body member 8 includes a hole 10 from which the initiator 1 may be easily suspended for placement into position. The inner diameter 11 of member 8 is larger than that of member 4. An axial bore 12 is provided in upper body member 8.

An inner housing 13 is axially slidably mounted in the outer housing fromed by member 4,5 and 8 as shown, and is axially restrained relative to the outer housing by shear pins 14 which extend through and are secured in bores 15 in tubular member 13 and bores 16 in member 5. Dirt, dust particles, humidity and the like are prevented from entering the initiator between tubular member 13 and cap 5 by an O-ring 17. A foot 18 is attached by means of threads on tubular member 13 and is sealed by an O-ring 19. Foot 18 and tubular member 13 together form an actuating member. A detonation assembly 20 being attached by means of threads inside the housing member 13, and includes a plate 21 holding individual parts of the firming mechanism in place. It is secured to the main body portion 22 of the assembly by two screws 23. Main body portion 22 of the detonation assembly is provided with a pair of bores 24 within which are a pair of firing pins 25. Firing pins 25 are maintained in the proper position by means of a plate. Firing pins 25 contact percussion primers 27, which abut initiating charges 28. The latter are positioned to detonate main explosive charge 29 contained in inner housing member 13.

Figure 2:
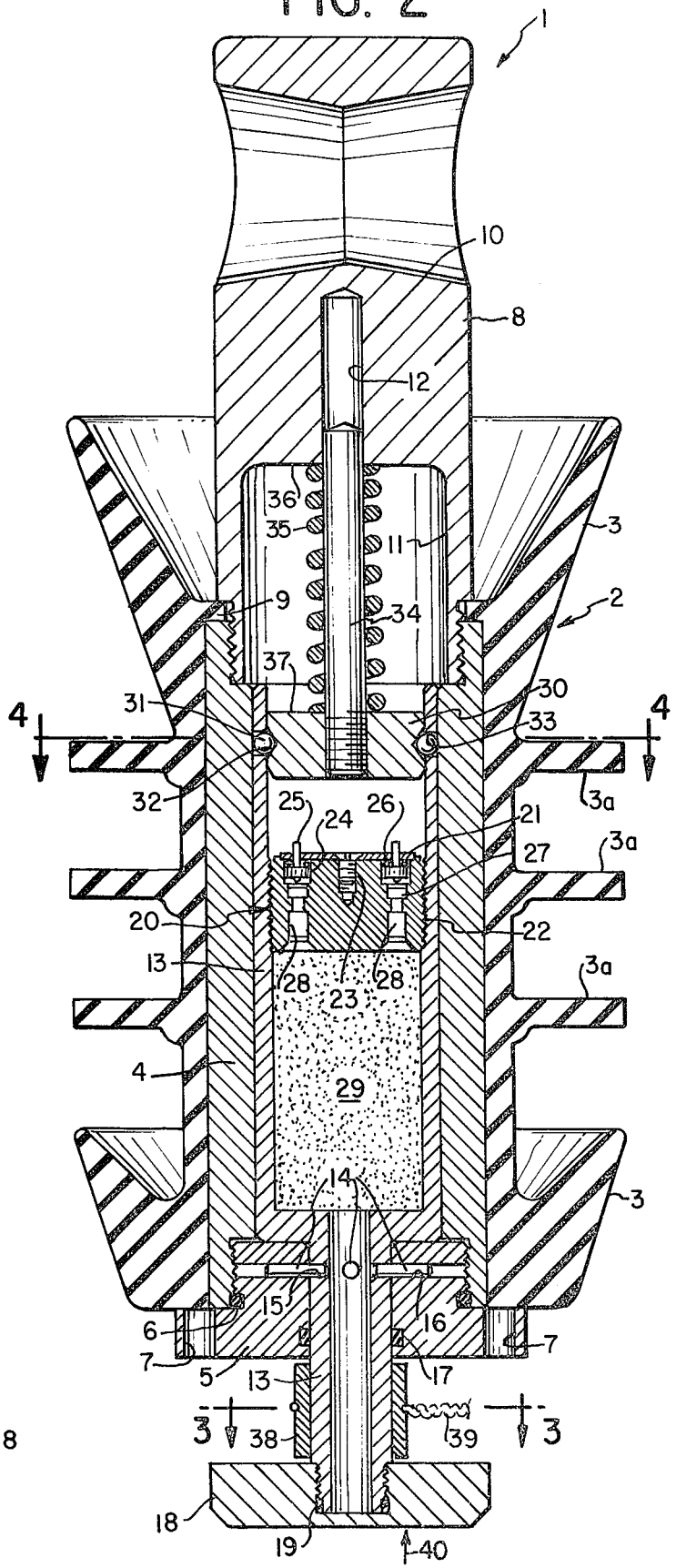
FIG. 2 is a cross-sectional view of the mechanical initiator illustrated in FIG. 1.
Figure 3:
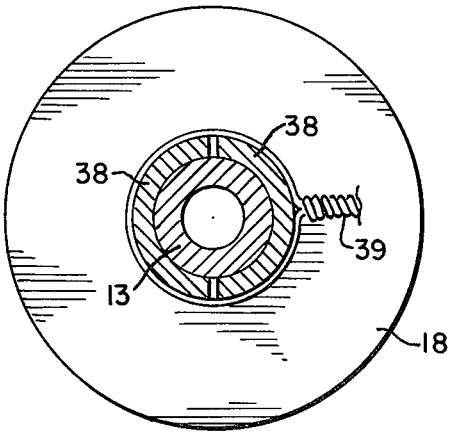
FIG. 3 is a cross-sectional view along line 3—3 of FIG. 2.
Figure 4:
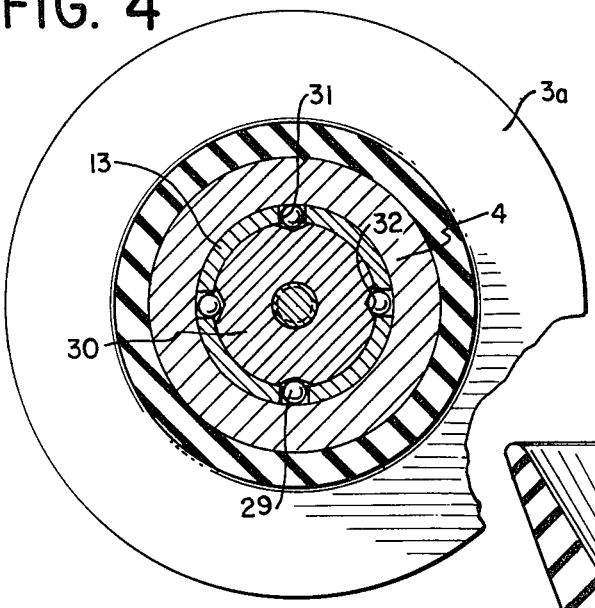
FIG. 4 is a cross-sectional view along line 4—4 of FIG. 2.

As can be seen most clearly in FIGS. 1 and 2, a firing head 30 is axially slidably positioned within inner housing member 13. Firing head 30 is maintained in the proper axial position by a ball lock comprising a plurality of steel balls 31 which rest in cooperating detents 32 in firing head 30 and bores 33 in inner housing member 13. Alternatively, an annular groove may be provided in place of detents 32. A shaft 34 threadedly mounted in firing head 30 extends into bore 12 of member 8. A spring 35 is disposed around shaft 34 and maintained in compression between wall 36 in member 8 and upper surface 37 of firing head 30.

Figure 5:
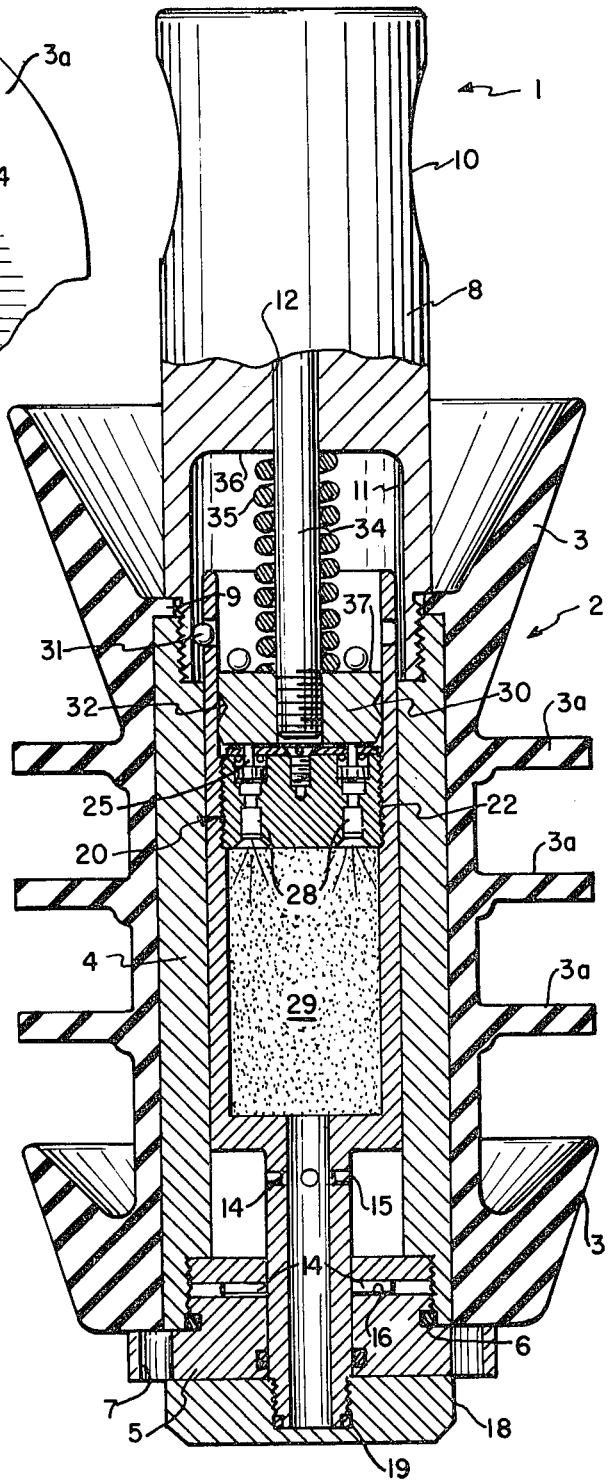
FIG. 5 is a cross-sectional view of the initiator illustrated in FIG. 2 during actuation.

The mechanical initiator is actuated through the application of an upward force to foot 18. In order to prevent accidental actuation of the initiator during transport or the like, the initiator may be provided with a pair of safety guards 38 which are disposed around inner tubular member 13 and secured in that position by a wire 39 which has both its ends twisted around each other, as shown most clearly in FIGS. 1 and 3. When it is desired to actuate the device, guards 38 having been removed, pressure is applied against foot 18 in the direction of arrow 40. If the force is greater than the shearing threshold force of pins 14, the pins will shear and housing member 13 will advance upwardly within the outer housing. In the preferred embodiment shown, four pins each of which shears at 750 pounds of force are used resulting in a requirement of at least 3000 pounds of force in order to actuate the device. In a 7 inch diameter well casing, the area of the top of the device is approximately 38 square inches so that pumping pressures of the order of 80 pounds per square inch will actuate the device. When inner housing member 13 has advanced to the point where balls 31 are just beyond the interface of outer housing members 4 and 8, unlocking firing head 30 from the inner housing 13 through the camming action of detents 32, spring 35 drives firing head 30 downward upon firing pins 25, as illustrated in FIG. 5. Firing pins 25 in turn actuate percussion primers 27, causing the ignition of the initiation charge 28 and the main charge of explosive 29 within inner housing 13. The main charge of explosive 29 may be any suitable explosive such as TNT or HMX conventionally employed as initiating charges.

It will be understood by those familiar with this art that variations and modifications of the disclosed preferred embodiment may be made without departing from the scope and spirit of the invention as defined by the appended claims.

What is claimed is:

1. A mechanically actuable initiator responsive to direct mechanical actuation by a force about a threshold magnitude along a predetermined axial direction and non-responsive to forces in other directions, comprising:

a. an outer housing defining within it an axially extending chamber:

b. an inner housing axially movable within said chamber and forming an inner chamber for containing an explosive therein, one wall of said inner chamber forming at least one cavity in communication with said inner chamber for containing a primer charge;

c. a bore extending from said cavity through said one wall for slidably mounting a firing pin therein to fire such primer charge and consequently said explosive;

d. an actuating member extending from the inner housing and passing through one end of said outer housing for axially moving the inner housing in the outer housing;

e. a firing head axially movable within said inner housing;

f. locking means (i) for locking the firing head to the inner housing in a first position of the inner housing with respect to the outer housing to prevent relative axial movement between the firing head and inner housing, and (ii) responsive to movement of the inner housing in the outer housing to a second position for unlocking the firing head for axial movement with respect to the inner housing; and g. means biasing the firing head toward said one wall of the inner chamber so that an axial force upon the actuating member moves the inner housing in the outer housing from the first to the second position, unlocking the locking means to permit the means biasing the firing head to drive it down upon the firing pin and thereby detonate the primer charge and thus the explosive.

2. An initiator as in claim 1, further comprising mechanical means (i) for maintaining said inner housing in said first position, and (ii) responsive to a force of predetermined magnitude applied to said actuating member to allow said inner housing to move axially into said second position.

3. An initiator as in claim 2, wherein said means for maintaining said inner housing and said outer housing in a first position with respect to each other comprises at least one pin which extends through said inner housing and said outer housing, said pin shearing when it is subjected to a force of predetermined magnitude.

4. An initiator as in claim 3, wherein said means biasing the firing head is a spring coupled to said outer housing and said firing head.

5. An initiator as in claim 4, wherein said spring is disposed around a shaft slidably mounted in said outer housing and secured to said firing head.

6. An initiator as in claim 5, wherein one end of said outer housing is enlarged, said firing head includes at least one detent and said locking means comprises a ball lock having at least one ball lodged in a hole in said inner housing and engaging said detent in said firing head whereby displacement of said inner housing towards the enlarged end of said outer housing to a position where said ball is adjacent said enlarged end results in displacement of said ball towards the wall of said enlarged end and consequent disengagement of said detent by said ball.

7. An initiator as in claim 1, wherein one end of said outer housing is enlarged, said firing head includes at least one detent and said locking mean comprises at least one body lodged in a hole in said inner housing and engaging said detent in said firing head, whereby displacement of said inner housing towards the enlarged end of said outer housing to a position where said body is adjacent said enlarged end results in displacement of said body towards the wall of said enlarged end and consequent disengagement of said detent by said body.

8. An initiator as in claim 1, wherein the cross-sectional area of said actuating member transverse to the axial direction is less than that of the outer housing.

* * * * *